United States Patent [19]

Borgström et al.

[11] Patent Number: 4,861,329

[45] Date of Patent: Aug. 29, 1989

[54] CENTRIFUGAL SEPARATOR

[75] Inventors: Leonard Borgström, Bandhagen; Claes G. Carlsson; Peter Franzén, both of Tullinge; Claes Inge, Saltsjö-Duvnäs; Torgny Lagerstedt; Hans Moberg, both of Stockholm; Olle Nabo, Tullinge, all of Sweden

[73] Assignee: Alfa-Laval Separation AB, Sweden

[21] Appl. No.: 280,714

[22] Filed: Dec. 6, 1988

[30] Foreign Application Priority Data

Dec. 7, 1987 [SE] Sweden ..... 8704871

[51] Int. Cl.[4] ..... B04B 1/08

[52] U.S. Cl. ..... 494/73

[58] Field of Search ..... 494/68, 69, 70, 71, 494/72, 73, 74, 75; 210/781, 782, 360.1; 422/72

[56] References Cited

U.S. PATENT DOCUMENTS

| | | | |
|---|---|---|---|
| 1,474,379 | 11/1923 | Robertson | 494/70 |
| 4,009,823 | 3/1977 | Stepanovich | 494/73 |
| 4,460,352 | 7/1984 | Bruning | 494/70 |
| 4,701,158 | 10/1987 | Inge | 494/74 |
| 4,721,505 | 1/1988 | Inge | 494/74 |

*Primary Examiner*—Robert W. Jenkins

*Attorney, Agent, or Firm*—Davis Hoxie Faithfull & Hapgood

[57] ABSTRACT

In the rotor of a centrifugal separator a stack of conical separation discs (4) is arranged concentric with the rotor axis. The rotor has an inlet for a dispersion and an outlet for liquid having been freed from a substance dispersed therein. In each space between adjacent separation discs (4) the disc surface from which the dispersed substance moves away as a consequence of centrifugal force during rotor operation has flow influencing members, whereas the surface of the other separation disc, situated opposite to said members, is substantially smooth. The relation (L/H) where L is the distance between adjacent flow influencing members and H is the distance between the separation discs, and the relation (1/H) where 1 is the extension of each flow influencing member along the disc surface and H is the distance between the separation discs, are larger than zero but less than 2.

6 Claims, 3 Drawing Sheets

CENTRIFUGAL SEPARATOR

The present invention relates to a centrifugal separator for the separation of a substance that is dispersed in a liquid, comprising a rotor having a separation chamber, an inlet for a dispersion, an outlet for separated liquid, a stack of conical separation discs arranged coaxially with the rotor in the separation chamber, and flow influencing members situated in at least a part of the interspaces between the separation discs. These members in each of said interspaces are arranged in contact with the surface of the one of the separation discs, from which the dispersed substance will move away during operation of the rotor as a consequence of centrifugal force, but at a distance from the surface of the other separation disc towards which the dispersed substance will move during operation of the rotor as a consequence of centrifugal force, so that a space is formed between the members and said other separation disc which admits flow of dispersion in the circumferential direction of the rotor past the members, said flow influencing members forming flow paths between themselves extending between radially outer and inner areas of said one separation disc.

A centrifugal separator of this kind, described in the Swedish patent specification No. 7503054-4, is equipped with flow influencing members in the form of radially extending ribs. It is stated that these ribs give the result that in each interspace between the separation discs "the flow is distributed in a manner such that the largest part (80–90%) of the suspension flows in the interspaces between the ribs 15", whereas in the space between the ribs and the separation disc towards which suspended particles move during the rotor operations as a consequence of centrifugal force, "there are formed stagnation zones, where the suspension flows at a small speed". As a consequence thereof, it is further stated, a decrease of the speed gradient is obtained near the separation disc surface towards which suspended particles are moved by the centrifugal force, so that a more effective separation of these particles may be obtained. The efficiency of a centrifugal separator, it is said, may thereby be increased 2–5 times in comparison with that of a conventional centrifugal separator.

Neither the details about the shape and location of the ribs nor the explanation as to the function of the ribs given in said patent specification can be used in practice to obtain an improvement of the efficiency of a centrifugal separator, in accordance with what is alleged. The reason therefore will be evident from the following.

The object of the present invention is to provide a centrifugal separator of the type described which is designed such that a substantial improvement of the separation efficiency can be obtained by means of flow influencing members between the separation discs.

According to the invention this is possible if the flow influencing members are formed so as to prevent, to a substantial degree, the formation of so-called Ekman layers along the surface of said one separation disc. This involves having the relation between the distance between adjacent flow influencing members, seen in the circumferential direction of the rotor, and the distance between the separation disc surfaces, and also the relation between the extension of each member in the circumferential direction of the rotor and the distance between the separation disc surfaces, larger than zero but less than 2, preferably between 0.2 and 1.0. According to the invention the surface of said other separation disc, opposite to the flow influencing members, is formed in a manner known per se for the obtainment of Ekman layers along the same during operation of the rotor.

By this invention it is possible to prevent formation of so-called Ekman layers at the separation disc surfaces having flow influencing members and, instead, to establish close to these separation disc surfaces a flow providing the same effect as a very thick hypothetical Ekman layer. In other words, the effect is obtained that the radial flow of dispersion in each interspace is distributed such that the main part of the radial flow arises close to the flow influencing members and only a small part arises near the separation disc surface towards and along which substance separated from the dispersion should move. By the particular shape of the flow influencing members, there is avoided a turbulent flow of the dispersion in the interspace between the separation discs which would counteract an effective separation of the dispersed substance. Such an undesired turbulence between the separation discs may arise in an arrangement of the flow influencing members according to the previously mentioned Swedish patent specification. Furthermore, in this known arrangement so-called Ekman layers will be formed between the ribs as well as on the upper sides of the same, for which reason the radial flow of dispersion will be of substantially the same magnitude along both of the two separation discs limiting the interspace in question.

In a preferred embodiment of the invention the flow influencing members have the form of evenly distributed protuberances from said one separation disc surface in each plate interspace, each protuberance having substantially the same extension in all directions along the disc surface. By such a rough and a homogeneous structure of the disc surface substantially uniform flow conditions can be obtained along the whole disc surface.

The invention is described in the following with reference to the accompanying drawing, in which.

Figure 1:
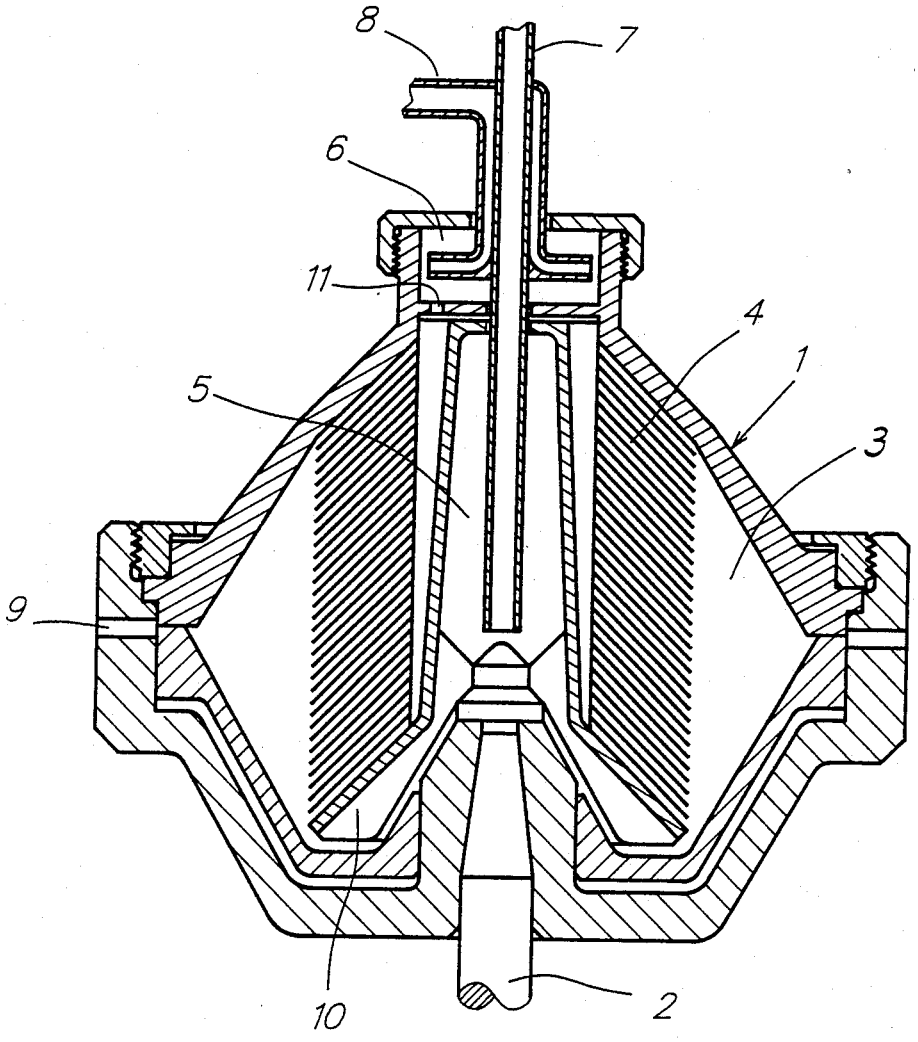
FIG. 1 is a view in vertical section of a centrifugal separator having conical separation discs, to which the invention is applicable.

FIG. 1 shows a centrifuge rotor 1 supported by a vertical drive shaft 2. Within the rotor a separation chamber 3 is formed in which is arranged, coaxially with the rotor, a stack of frustoconical separation discs 4. The rotor 1 has a central inlet chamber 5 for a dispersion of components to be separated in the separation chamber 3, and a central outlet chamber 6 for a separated relatively light liquid. A stationary inlet tube 7 extends into the inlet chamber 5, and stationary outlet member 8 extends into the outlet chamber 6. At its periphery the rotor has an intermittently openable outlet 9 for a separated relatively heavy component, e.g., sludge, that before the separation constituted the dispersed phase of the supplied dispersion. The inlet chamber 5 communicates with the separation chamber 3 through several radial channels 10 evenly distributed around the rotor axis. Through an overflow outlet 11 the separation chamber 3 communicates with the outlet chamber 6.

Figure 2:
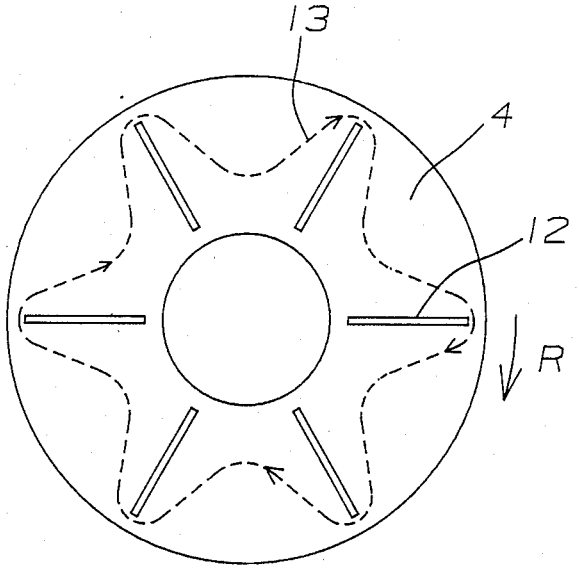
FIG. 2 is a plan view of a conical separation disc.

FIG. 2 shows a separation disc 4 which on its upper side is provided with a number of radially extending ribs 12 intended to serve as spacing means between this separation disc and an adjacent separation disc in a centrifuge rotor according to FIG. 1. The intended direction of rotation is shown by means of an arrow R.

During operation of a centrifuge rotor according to FIG. 1 a dispersion supplied to the inlet chamber 5 is caused to rotate at the same speed as the rotor during its passage through the radial channels 10. The angular speed which the dispersion has reached in the area of the outer edges of the separation discs 4 will increase further when the dispersion is forced to flow back towards the rotor axis between the separation discs. This increase of the angular speed, depending on the fact that each part of the rotating dispersion is striving to maintain its momentum, cannot be prevented by spacing members between the separation discs, such as ribs of the kind shown in FIG. 2.

As a consequence of the above a flow of dispersion will arise in each interspace between adjacent separation discs, that is directed substantially around the rotor axis. This flow having a speed in the circumferential direction of the rotor larger than that of the separation discs themselves is named, in the description which follows, a geostrophic flow. A flow line for part of this geostrophic flow is shown in FIG. 2 and is designated 13. As shown, the ribs 12 form obstacles to a substantially circular geostrophic flow. Such a circular flow can be obtained, however, if the ribs are substituted by spot-like protuberances as sometimes used.

Figure 3:
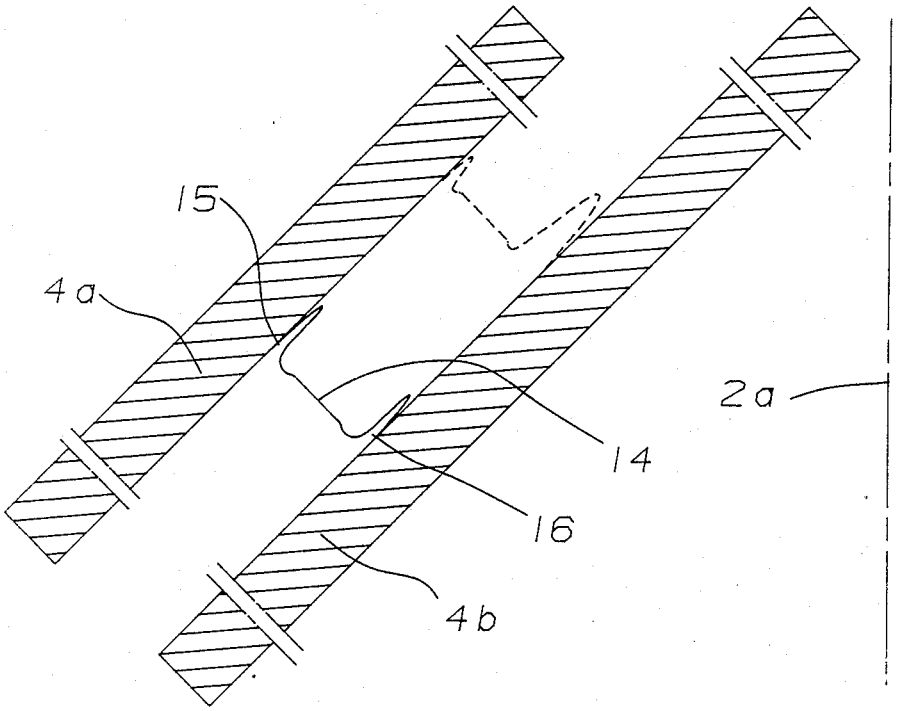
FIG. 3 is a schematic view in radial section through two smooth separation discs and the interspace therebetween.

The geostrophic flow of the dispersion moving around the rotor axis, i.e., substantially in the circumferential direction of the rotor, the formation of which, however, thus depends on the fact that the dispersion is forced to move towards the rotor center through the disc interspaces, meets friction at the surfaces of the separation discs. As a consequence of this friction a flow of liquid arises in a very thin layer closest to each disc surface, which flow has a substantially larger component directed radially inwards than the geostrophic flow, at least where the latter goes in the circumferential direction of the rotor. The thin layer is usually called an Ekman layer. In the case just described, when the geostrophic flow moves faster than the separation discs, the liquid in the Ekman layers flows along the disc surfaces radially inwards If the geostrophic flow had been moving slower than the separation discs, which would have happened if the dispersion had been forced to move radially outwards through the disc interspaces, the liquid in the Ekman layers would instead have been flowing radially outwards FIG. 3 illustrates how the radial flow may be distributed in different layers of an interspace between two conventional smooth separation discs 4*a* and 4*b*. The rotor axis is illustrated by a line 2*a*. The radial flow velocity is zero at the surfaces of the separation discs and substantially zero also in a large area 14 midway between the separation discs. A substantial radial flow exists only in two layers 15 and 16 close to the separation discs. These layers are the two so-called Ekman layers. Substantially all dispersion to flow through the space between the separation discs 4*a* and 4*b* from their outer edges to their inner edges is thus forced to flow radially inwards in the layers 15 and 16 The thickness of each Ekman layer for most practical operating conditions is on the order of 1/10 of the distance between two adjacent separation discs.

A substance dispersed in the dispersion, e.g., small solids heavier than the carrying liquid, will, under the centrifugal force in the interspace between the separation discs, strive to move radially outwards towards the separation disc 4*a* and along this towards its outer edge. Such a flow of solids towards and along the separation disc 4*a* will be made difficult by the radially directed dispersion flow in the layer 15. Therefore, it would be desirable to accomplish, if possible, a different distribution of the radially inwards directed flow of the dispersion, so that it would be smaller in the area 15 and larger in the area 16. Such a desired flow distribution is shown by a dotted line in FIG. 3.

Figure 4:
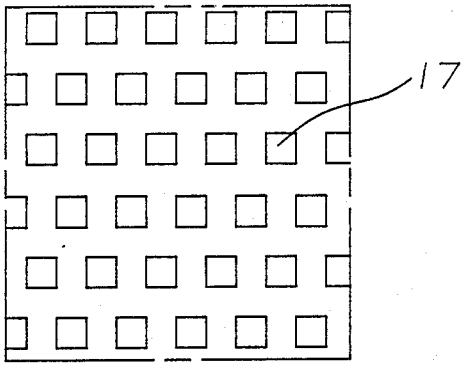
FIG. 4 is a schematic plan view of part of a separation disc provided with flow influencing members according to the invention.
Figure 5:
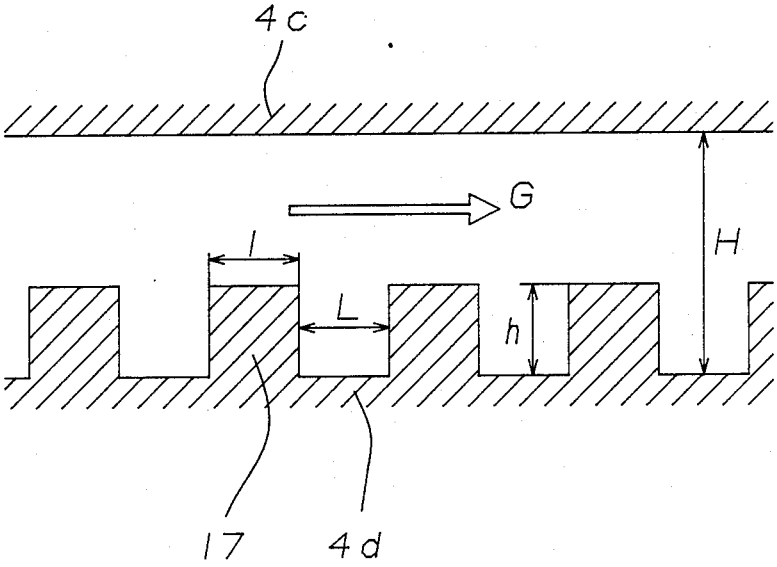
FIG. 5 is a schematic fragmentary view in vertical section showing an interspace similar to that in FIG. 3 but where one of the separation discs has flow influencing members according to the invention.

According to the invention this can be accomplished by providing the separation discs 4 on their upper sides with flow influencing members 17 shaped in a particular way, such as can be seen from FIG. 4 and FIG. 5. The flow influencing members 17 have to be so formed that they give the upper side of each separation disc a rough surface structure, which prevents the formation of an Ekman layer thereon. Furthermore, they have to be formed so that even if they create a substantially larger friction resistance for the geostrophic flow along said upper side than a smooth surface would, they will still not cause turbulence in a large part of the disc interspace. Such turbulence would make it difficult or impossible, for the intended separation of the dispersed substance to take place. According to the invention the flow influencing members, in order to obtain the desired effect, have to be formed so that the relation between the distance between adjacent members, seen in the circumferential direction of the rotor, and the distance between the separation discs, and also the relation between the extension of each member in the circumferential direction of the rotor and the distance between the separation discs, is less than 2.

The just used expression "in the circumferential direction of the rotor" should be understood as "in the direction of the geostrophic flow".

Flow influencing members may not be required across the whole upper side of each separation disc. Particularly if ribs or other flow obstacles are present in the plate interspaces it is possible that flow influencing members may be avoided over parts of said upper side.

FIG. 5 shows a section through parts of two adjacent separation discs 4*c* and 4*d* and the interspace therebetween. The upper side of the lower disc 4*d* has a number of flow influencing members 17 (see also FIG. 4) each with an extension 1 along the plate surface and a height h above the same. The distance between two adjacent flow influencing members is designated L and the distance between the separation discs is designated H. The direction of the geostrophic flow in the disc interspace is shown by an arrow G.

Generally accepted theories about so-called Ekman layers show that formation of an Ekman layer requires a geostrophic flow a certain minimum distance along a surface. This distance is relatively short. By the above defined relation between the distance between the separation discs and the mutual distance between the flow influencing members and their extension along the disc surface in question, respectively, i.e., that 1/H and L/H should be less than 2, no Ekman layer will be formed on the upper side of the separation disc 4*d* in connection with practically used parameters such as flow, viscosity, rotational speed, etc., for centrifugal separators of the kind here concerned. Furthermore, by the defined relation turbulence in the disc interspace above the flow influencing members 17 is avoided.

The height h of each flow influencing member 17 may vary within wide limits according to the invention. Preferably, however, the relation h/H, i.e., the relation between the height of each member and the distance between the separation discs, should be in the range 0.2–0.5.

In a centrifugal separator of the kind for which the invention is intended, the disc plate thickness usually is on the order of 0.5–1.0 mm, and the distance (H) between adjacent discs is on the order of 0.5–1.5 mm. This means that flow influencing members formed according to the invention may have a height of, for instance, 0.1–0.7 mm and an extension along the separation disc surface and the geostrophic flow of for instance 0.2–3.0 mm.

The invention has been described above applied to a case where a dispersion contains a dispersed substance heavier than the continuous phase of the dispersion. The invention can also be used in connection with separation of a dispersed substance which is lighter than the continuous phase of the dispersion, e.g., separation of cream from milk.

In this case the flow influencing members should be situated on the under side of the conical separation discs, i.e., on the disc side from which the dispersed substance moves away owing to centrifugal force during operation of the rotor.

As mentioned above the upper or lower sides of the separation discs need not be covered entirely by flow influencing members. Depending upon the shape of necessary spacing means between the separation discs, varying directions of geostrophic flow may arise. Flow influencing members are most important in the part of a disc interspace where the strongest counter-flow can be expected between the separated dispersed substance an Ekman layer formed as a consequence of the geostrophic flow.

Only one form of the flow influencing members has been described above. Any other form thereof is possible within the scope of the invention which will give parts of the separation discs a rough surface structure. A rough surface structure may be difficult or expensive to accomplish on separation discs made of metal. Therefore, the invention may prove to be especially applicable, in practice, when the separation discs are made of plastic, the flow influencing members being made in one piece with the separation discs.

What we claim is:

1. In a centrifugal separator for the separation of a substance dispersed in a liquid, comprising a rotor having a separation chamber, an inlet for a dispersion, an outlet for separated liquid, a stack of conical separation discs arranged coaxially with the rotor in the separation chamber and having interspaces between them, and flow influencing members situated in at least part of the interspaces between the separation discs, which members in each of said interspaces are arranged in contact with the surface of the one of the separation discs, from which the dispersed substance moves away during operation of the rotor as a consequence of centrifugal force but at a distance from the other separation disc towards which the dispersed substance moves during operation of the rotor as a consequence of centrifugal force so that a space is formed between the members and said other separation disc admitting flow of dispersion in the circumferential direction of the rotor past the members, said flow influencing members forming flow paths between themselves extending between radially outer and inner areas of said one separation disc, the improvement in which said flow influencing members are formed and positioned to prevent to a substantial degree the formation of Ekman layers along the surface of said one separation disc and so that the relation (L/H), where L is the distance between adjacent flow influencing members, seen in the circumferential direction of the rotor, and H is the distance between the surfaces of the separation discs, and the relation (1/H), where 1 is the extension of each flow influencing member in the circumferential direction of the rotor and H is the distance between the surfaces of the separation discs, are greater than zero but less than 2;

and the surface of said other separation discs, opposite to the flow influencing members is formed to promote the formation of an Ekman layer along the same during operation of the rotor.

2. Centrifugal separator according to claim 1 in which the flow influencing members are formed and placed to give said one separation disc a substantially homogeneous surface structure on at least a part of one side of said disc.

3. Centrifugal separator according to claim 1 in which the flow influencing members have the same shape.

4. Centrifugal separator according to claim 3 in which each flow influencing member has substantially the same extension in all directions along the surface of said one separation disc.

5. Centrifugal separator according to claim 1 wherein the relation (h/H) is in the range from about 0.2 to about 0.5, h being the height of the flow influencing member.

6. Centrifugal separator according to claim 1 wherein the relation L/H, and the relation 1/H are larger than 0.2 but less than 1.0.

* * * * *